US009268270B2

(12) United States Patent
Hashiguchi et al.

(10) Patent No.: US 9,268,270 B2
(45) Date of Patent: Feb. 23, 2016

(54) IMAGE HEATING APPARATUS

(71) Applicant: CANON KABUSHIKI KAISHA, Tokyo (JP)

(72) Inventors: Shinji Hashiguchi, Mishima (JP); Kenji Kanari, Numazu (JP); Keisuke Mochizuki, Suntou-gun (JP); Masato Sako, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/098,966

(22) Filed: Dec. 6, 2013

(65) Prior Publication Data

US 2014/0161498 A1 Jun. 12, 2014

(30) Foreign Application Priority Data

Dec. 11, 2012 (JP) ..... 2012-270301

(51) Int. Cl.
*G03G 15/20* (2006.01)

(52) U.S. Cl.
CPC .... *G03G 15/2053* (2013.01); *G03G 2215/0132* (2013.01); *G03G 2215/2035* (2013.01)

(58) Field of Classification Search
USPC ..... 399/329
See application file for complete search history.

(56) References Cited

U.S. PATENT DOCUMENTS

| | | | |
|---|---|---|---|
| 5,525,775 | A | 6/1996 | Setoriyama et al. |
| 7,190,914 | B2 | 3/2007 | Nihonyanagi et al. |
| 7,215,899 | B2 | 5/2007 | Kimizuka et al. |
| 7,251,447 | B2 | 7/2007 | Kanamori et al. |
| 7,280,775 | B2 | 10/2007 | Kubochi et al. |
| 7,283,780 | B2 | 10/2007 | Uchida et al. |
| 7,512,370 | B2 | 3/2009 | Shimizu et al. |
| 7,518,089 | B2 | 4/2009 | Hashiguchi et al. |
| 8,068,757 | B2 | 11/2011 | Hashiguchi |
| 8,112,024 | B2 | 2/2012 | Saito et al. |
| 8,265,507 | B2 | 9/2012 | Saito et al. |
| 8,472,826 | B2 | 6/2013 | Hashiguchi |
| 2006/0233575 | A1 | 10/2006 | Uchida et al. |
| 2013/0039683 | A1 * | 2/2013 | Fujita et al. ..... 399/329 |

FOREIGN PATENT DOCUMENTS

| | | | |
|---|---|---|---|
| JP | 4-44075 | A | 2/1992 |
| JP | 2006-293225 | A | 10/2006 |
| JP | 2012-255870 | A | 12/2012 |

* cited by examiner

*Primary Examiner* — Minh Phan

(74) *Attorney, Agent, or Firm* — Fitzpatrick, Cella, Harper & Scinto

(57) ABSTRACT

The fixing apparatus includes a sleeve, a nip portion forming member that contacts an inner surface of the sleeve, a pressure member, and a regulation member for regulating movement of the sleeve. The regulation member includes a first surface and a second surface. The first surface on an upstream side of the nip portion in a conveyance direction of the recording material includes a region in which the distance between the inner surface of the sleeve and the first surface in a radial direction of the sleeve increases toward a center portion of the sleeve in the generatrix direction, and in which the end surface of the sleeve contacts the region when the sleeve moves in the generatrix direction.

6 Claims, 7 Drawing Sheets

IMAGE HEATING APPARATUS

BACKGROUND OF THE INVENTION

1. Field of the Invention

The present invention relates to an image heating apparatus to be used in an image forming apparatus, such as a copier and a laser beam printer (LBP), which adopts an image forming process of an electrophotographic system or an electrostatic recording system. As such an image heating apparatus, there is known a fixing apparatus for heating and fixing an unfixed toner image formed on a recording material (transfer material, printing paper, photosensitive paper, electrostatic recording paper, etc.) as a fixed image. Further, there is also known a glossiness enhancing apparatus for enhancing the glossiness of an image by heating the image fixed to a recording material.

2. Description of the Related Art

Hitherto, as a fixing apparatus provided in an image forming apparatus such as a copier, a printer, and a facsimile of an electrophotographic system, a contact-heating type, heat-roller system having satisfactory thermal efficiency and a film heating system having quick start property (on-demand property) have been used. The fixing apparatus of a film heating system can realize a small heat capacity and suppress power consumption during a standby state through the use of a heat-resistant film or a metal sleeve (hereinafter referred to as "fixing sleeve") serving as a hollow rotatable heating rotary member which is heated by a heating source, and hence this fixing apparatus provides excellent energy savings. Specifically, Japanese Patent Application Laid-Open No. H04-44075 discloses a fixing apparatus of a film heating system.

In the fixing apparatus as described above, a recording material bearing an image is conveyed to a nip portion formed between a heating rotary member and a pressure member, and is nipped therebetween to heat the image. The fixing apparatus includes a holding member provided at an end portion in a rotation axis direction of a fixing sleeve serving as the heating rotary member, and the holding member includes a regulation surface for holding an inner surface of the fixing sleeve at a position on an upstream side of the nip portion, and a regulation surface for regulating the movement in the rotation axis direction of the fixing sleeve. Specifically, a fixing flange includes a regulation surface serving as a shift regulation member, as well as a regulation surface serving as a holding member to be brought into internal contact with a fixing sleeve end portion to stabilize the shape of the fixing sleeve during rotation.

However, in the above-mentioned related art, when the movement force (shift force) in the rotation axis direction (thrust direction) of the fixing sleeve is too strong, there is a risk that the end surface of the fixing sleeve and the shift regulation member strongly rub against each other to shave and damage the shift regulation member and the metal sleeve. Alternatively, there is a risk that the end portion of the fixing sleeve buckles and is damaged.

SUMMARY OF THE INVENTION

According to an aspect of the invention, the purpose of the invention is to provide a fixing apparatus for fixing a toner image onto a recording material by heating the recording material bearing the toner image while conveying the recording material through a nip portion. The fixing apparatus includes a sleeve, a nip portion forming member that contacts an inner surface of the sleeve, a pressure member that forms the nip portion together with the nip portion forming member through the sleeve, and a regulation member that regulates movement of the sleeve. The regulation member includes a first surface opposed to an inner surface of an end portion of the sleeve in a generatrix direction of the sleeve, and a second surface opposed to an end surface of the sleeve in the generatrix direction of the sleeve. The regulation member does not rotate together with the sleeve. The first surface on an upstream side of the nip portion in a conveyance direction of the recording material includes a region in which the distance between the inner surface of the sleeve and the first surface in a radial direction of the sleeve increases toward a center portion of the sleeve in the generatrix direction. The end surface of the sleeve contacts the region when the sleeve moves in the generatrix direction of the sleeve.

Further features of the present invention will become apparent from the following description of exemplary embodiments with reference to the attached drawings.

DESCRIPTION OF THE EMBODIMENTS

First Embodiment

Image Forming Apparatus

Figure 3:
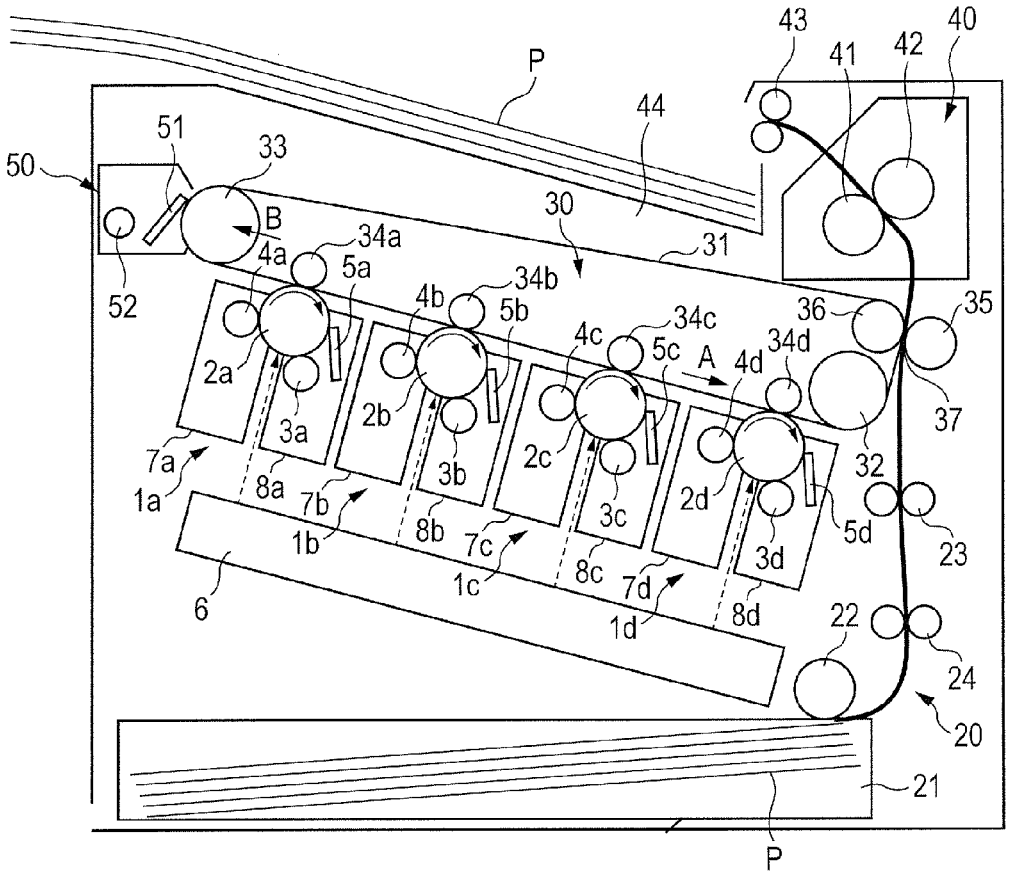
FIG. 3 is a schematic sectional explanatory view of an image forming apparatus in which the fixing apparatus serving as the image heating apparatus according to the first embodiment of the present invention is mounted.

The entire configuration of an image forming apparatus is described together with an image forming operation with reference to FIG. 3. Note that, the image forming apparatus of the first embodiment is a color laser printer with a process speed of 135 mm/s and a throughput of 30 ppm (A4 size cross-feed) using an electrophotographic process.

The color laser printer includes toner cartridges 1*a*, 1*b*, 1*c*, and 1*d* removably mounted on an image forming apparatus main body. These four toner cartridges 1*a*, 1*b*, 1*c*, and 1*d* have the same structure except for formation of images with toners of different colors, that is, yellow, magenta, cyan, and black.

The toner cartridges 1*a*, 1*b*, 1*c*, and 1*d* respectively include developing units 7*a*, 7*b*, 7*c*, and 7*d* and image bearing member units 8*a*, 8*b*, 8*c*, and 8*d*. The developing units 7*a*, 7*b*, 7*c*, and 7*d* respectively include developing rollers 4*a*, 4*b*, 4*c*, and 4*d*. The image bearing member units 8*a*, 8*b*, 8*c*, and 8*d* respectively include photosensitive drums 2*a*, 2*b*, 2*c*, and 2*d* serving as image bearing members, charging rollers 3*a*, 3*b*, 3*c*, and 3*d*, drum cleaning blades 5*a*, 5*b*, 5*c*, and 5*d*, and waste toner containers.

A scanner unit 6 is provided below the toner cartridges 1*a*, 1*b*, 1*c*, and 1*d*, and exposes the photosensitive drums 2*a*, 2*b*, 2*c*, and 2*d* with light based on an image signal. That is, the photosensitive drums 2*a*, 2*b*, 2*c*, and 2*d* are charged at a predetermined negative potential respectively by the charging rollers 3*a*, 3*b*, 3*c*, and 3*d*. Then, electrostatic latent images are formed by the scanner unit 6. Toners of negative polarity adhere to the electrostatic latent images through reverse development by the developing units 7*a*, 7*b*, 7*c*, and 7*d*. In this way, toner images of yellow, magenta, cyan, and black are formed.

An intermediate transfer belt unit 30 includes an intermediate transfer belt 31 stretched around a drive roller 32, a secondary transfer opposed roller 36, and a tension roller 33, and the tension roller 33 applies tension in the arrow B direction. Primary transfer rollers 34*a*, 34*b*, 34*c*, and 34*d* are arranged on an inside of the intermediate transfer belt 31 so as to face the photosensitive drums 2*a*, 2*b*, 2*c*, and 2*d*, and a transfer shift is applied from a shift applying unit (not shown).

The toner images formed on the photosensitive drums 2*a*, 2*b*, 2*c*, and 2*d* are sequentially primarily transferred onto the intermediate transfer belt 31 when each of the photosensitive drums 2*a*, 2*b*, 2*c*, and 2*d* rotates in an arrow direction and the intermediate transfer belt 31 rotates in the arrow A direction. Specifically, when a positive shift is applied to the primary transfer rollers 34*a*, 34*b*, 34*c*, and 34*d*, the toner images on the photosensitive drums 2*a*, 2*b*, 2*c*, and 2*d* are primarily transferred onto the intermediate transfer belt 31 sequentially in an order from the toner image on the photosensitive drum 2*a*, and the toner images of four colors superimposed on each other are conveyed to a secondary transfer nip portion 37.

A feeding and conveying device 20 includes a sheet feed roller 22 for feeding a transfer material P from a sheet feed cassette 21 receiving the transfer material P and conveyance rollers 24 for conveying the fed transfer material P. Then, the transfer material P conveyed from the feeding and conveying device 20 is substantially vertically conveyed to the secondary transfer nip portion by a registration roller pair 23. In the secondary transfer nip portion 37, a positive shift is applied to a secondary transfer roller 35, with the result that the toner images of four colors on the intermediate transfer belt 31 are secondarily transferred onto the conveyed transfer material P.

The transfer material P with the toner images transferred thereto is conveyed to a fixing apparatus 40, and heated and pressurized by a fixing sleeve 41 serving as a heating rotary member and a pressure roller 42, with the result that the toner images are fixed onto the surface of the transfer material P. The transfer material P with the toner images fixed thereto is delivered to a discharge tray 44 by a discharge roller pair 43.

Toner remaining on the surfaces of the photosensitive drums 2*a*, 2*b*, 2*c*, and 2*d* after the toner image transfer is removed by cleaning blades 5*a*, 5*b*, 5*c*, and 5*d*. Further, toner remaining on the intermediate transfer belt 31 after the secondary transfer to the transfer material P is removed by a cleaning blade 51 of a transfer belt cleaning device 50, and the removed toner passes through a waste toner conveyance path 52 to be collected to a waste toner collecting container (not shown).

Image Heating Apparatus

Figure 2:
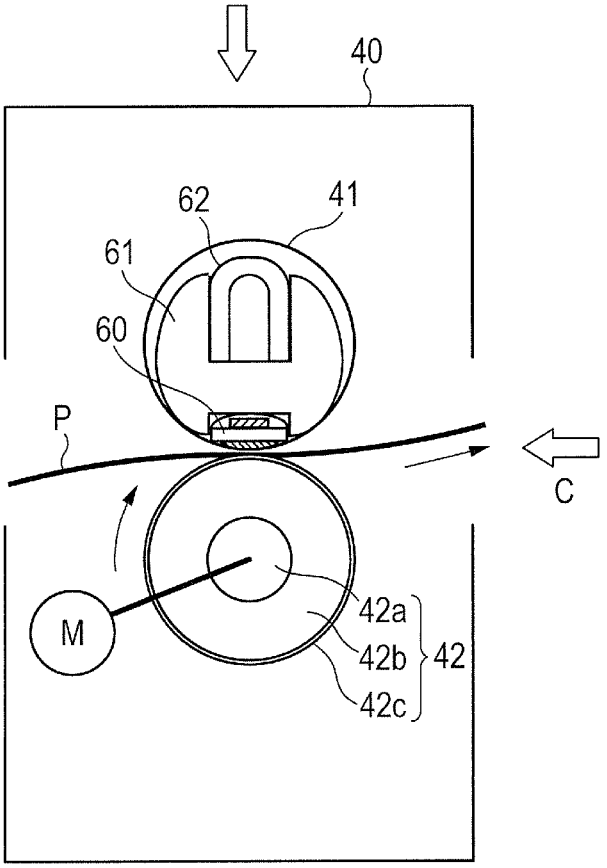
FIG. 2 is a schematic horizontal sectional view of the fixing apparatus according to the first embodiment of the present invention.
Figure 4:
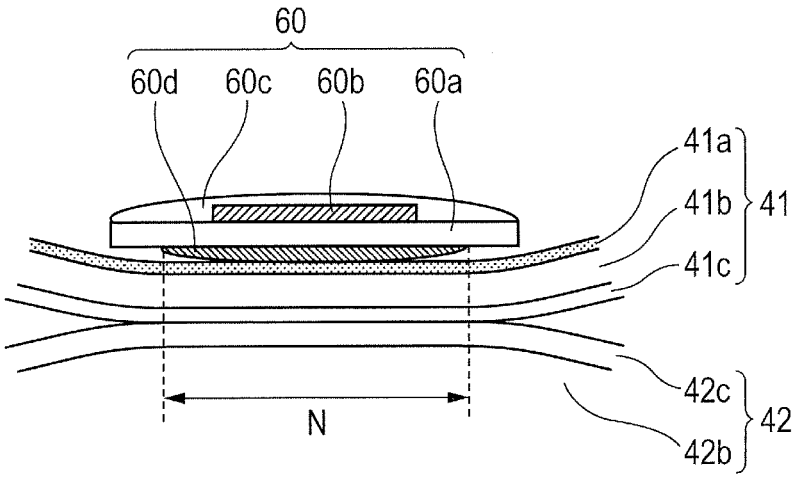
FIG. 4 is a schematic enlarged sectional view in a conveyance direction of a recording material in the vicinity of a nip portion of the fixing apparatus according to the first embodiment of the present invention.
Figure 5A:
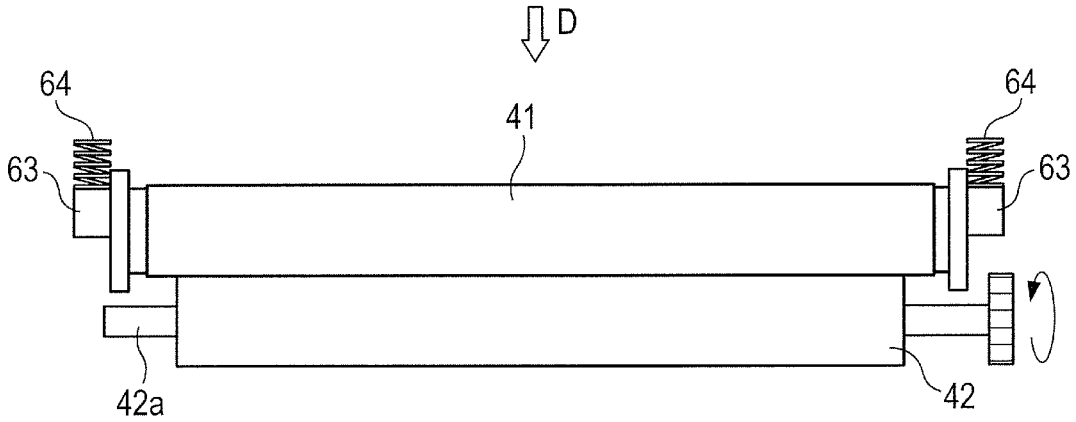
FIG. 5A is a schematic structural view in a rotation axis direction (longitudinal direction) of the fixing apparatus according to the first embodiment of the present invention.
Figure 5B:
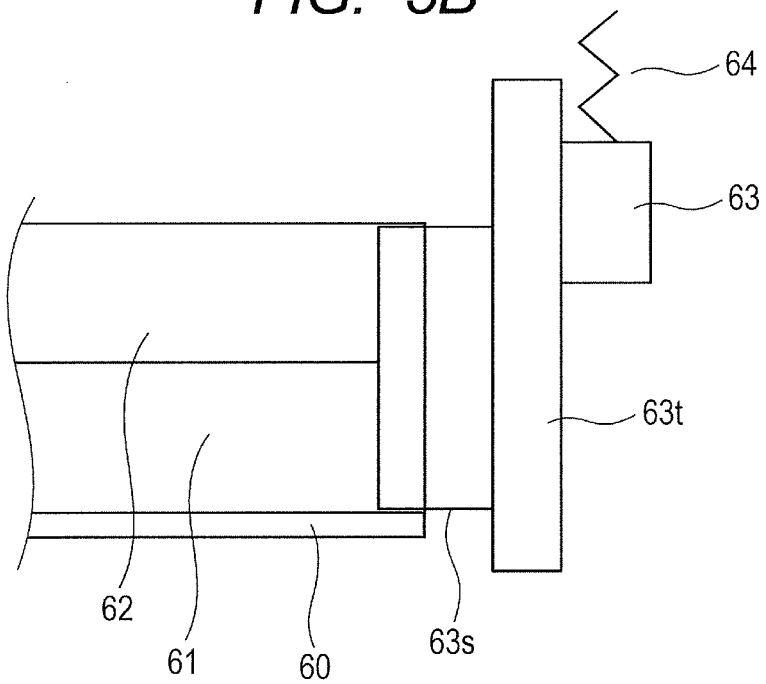
FIG. 5B is an explanatory view of an end-side member.

FIG. 2 is a schematic horizontal sectional view of the fixing apparatus 40 serving as the image heating apparatus, and FIG. 4 is a schematic enlarged sectional view in a conveyance direction of a recording material in the vicinity of a nip portion N of the fixing apparatus 40. Further, FIG. 5A is a schematic view of the heating rotary member in a rotation axis direction (longitudinal direction) when the fixing apparatus 40 is viewed from a conveyance downstream side (arrow C direction of FIG. 2) of the transfer material P. FIG. 5B is an explanatory view of the end-side member, in which components 63*s*, 63*t*, and 63*u* of a fixing flange 63 are provided. The component 63*s* according to the present invention is described later in detail.

The fixing apparatus 40 according to the first embodiment includes the fixing sleeve 41 serving as a flexible belt member, the pressure roller 42 serving as a pressure member, and a heater 60 serving as a heating source, and causes the pressure roller 42 to pressurize the heater 60. Further, the friction force between the heater and the fixing sleeve 41 is reduced by interposing a fixing grease (not shown) therebetween so that the fixing sleeve 41 is driven to rotate smoothly. In the fixing apparatus 40 as described above, a recording material bearing an image is conveyed to the nip portion N formed between the fixing sleeve 41 and the pressure roller 42, and is nipped therebetween to heat the image.

Fixing Sleeve

The fixing sleeve 41 serving as the hollow rotatable heating rotary member has a configuration in which an elastic layer 41*b* is formed on the outer periphery of a base layer 41*a* (FIG. 4) formed in an endless shape, and a releasing layer 41*c* is formed on the outer periphery of the elastic layer 41*b*. The fixing sleeve 41 has a cylindrical shape having an outer diameter of 24 mm. A resin-based material such as polyimide or a metal-based material such as Steel Use Stainless (SUS) is used for the base layer 41*a*. In the first embodiment, an SUS sleeve formed in an endless shape having a thickness of 30 μm was used considering strength.

It is desired that a material having as high a thermal conductivity as possible be used for the elastic layer 41*b* from the viewpoint of achieving a quick start. Thus, in the first embodiment, silicone rubber having a thermal conductivity of about 1.0×10-3 cal/(sec·cm·K) having a thickness of about 250 μm was used for the elastic layer 41*b*.

The releasing layer 41*c* is provided so as to prevent an offset phenomenon which occurs when toner temporarily adheres to the surface of the fixing sleeve 41 and moves to the transfer material P again. As a material for the releasing layer 41*c*, a fluorine resin such as polytetrafluoroethylene (PTFE) and perfluoroalkoxy (PFA) (PA), a silicone resin, or the like is used. In the first embodiment, the releasing layer 41*c* is formed as a PFA tubing having a thickness of about 30 μm, and the outer circumferential surface of silicone rubber serving as the elastic layer 41*b* is covered with the PFA tubing.

Pressure Roller

The pressure roller 42 serving as a pressure member has a configuration in which a conductive silicone rubber layer having a thickness of about 3 mm is formed as an elastic layer 42*b* on the outer circumferential surface of a metallic cored bar 42*a* (FIG. 2) in a cylindrical shaft shape, and the outer circumferential surface of the conductive silicone rubber layer is covered with a PFA tubing having a thickness of about 50 μm serving as a releasing layer 42*c*. Both end portions in the longitudinal direction of the cored bar 42*a* are held by a frame of the fixing apparatus 40 through bearings (not shown) so that the pressure roller 42 is opposed to the heater 60 in parallel. A roller portion formed of the elastic layer 42*b* and the releasing layer 42*c* of the pressure roller 42 has an outer diameter of 25 mm and a longitudinal width of 325 mm.

The pressure roller 42 is rotated by a driving unit M at a circumferential speed of 135 mm/sec in the arrow direction. The fixing sleeve 41 is driven to rotate around a heater holder 61 at the same speed as the rotation speed of the pressure roller 42 due to the friction force between the fixing sleeve 41 and the pressure roller 42.

Heater

The heater 60 serving as a heating source includes an elongated substrate 60*a* (FIG. 4) in a longitudinal direction (direction orthogonal to the conveyance direction of a recording material). The substrate 60*a* is a highly heat-conductive insulating substrate formed of ceramics such as alumina and aluminum nitride. In the first embodiment, alumina formed in a rectangular shape having a thickness of 1 mm, a width of 8 mm, and a longitudinal size of 375 mm is used as the substrate 60*a* considering the balance between heat capacity and strength. Note that, in the first embodiment, the heater 60 also serves as a nip portion forming member.

A heat resistive layer 60*b* serving as a heat generator is formed in the longitudinal direction of the substrate 60*a* on a back surface of the substrate 60*a*. The heat resistive layer 60*b* contains an AgPd alloy, a NiSn alloy, a $RuO_2$ alloy, and the like as main components, and is molded so as to have a thickness of about 10 μm, a length of 310 mm, and a width of 4 mm. The heat resistive layer 60*b* generates heat by being supplied with a current from a power source (not shown) through both end portions.

An insulating glass layer 60*c* ensures insulation from an external conductive member by overcoating the heat resistive layer 60*b*. In addition, the insulating glass layer 60*c* has a corrosion-resistant function for preventing a change in resistance due to oxidation or the like of the heat resistive layer 60*b* and serves to prevent mechanical damages. Note that the insulating glass layer 60*c* has a thickness of 30 μm.

A sliding layer 60*d* is a layer having a thickness of 6 μm containing an imide-based resin such as polyimide and polyamideimide as a component, and is provided on a surface of the substrate 60*a* that slides against an inner circumferential surface of the fixing sleeve 41. The sliding layer 60*d* has a function excellent in heat resistance, lubricity, and abrasion resistance and imparts a smooth sliding property with respect to an inner circumferential surface of the fixing sleeve 41.

Heater Holder

The heater holder 61 serving as a backup member is formed of a heat-resistant resin such as a liquid crystal polymer resin having high heat resistance so as to have a semi-circular trough pail shape in lateral cross-section. Then, the fixing sleeve 41 is loosely fitted onto the outer periphery of the heater holder 61.

Pressure Stay

A pressure stay 62 serving as a skeletal member is formed of a material such as a metal having stiffness so as to have an inverted U-shape in lateral cross-section. The pressure stay 62 is disposed on a surface of the heater holder 61 opposite to the pressure roller 42 on an inner side of the fixing sleeve 41. The pressure stay 62 brings the heater 60 into abutment against the pressure roller 42 with the fixing sleeve 41 interposed therebetween through the intermediation of the heater holder 61 by the fixing flanges 63 and pressure springs 64 described later.

Flange

The fixing flanges 63 formed of a heat-resistant resin such as a liquid crystal polymer having high heat resistance (FIGS. 5A and 5B) are fitted in both end portions in a thrust direction (longitudinal direction) of the fixing sleeve 41. The fixing flanges 63 on the right and left sides support both end portions of the heater holder 61 and the pressure stay 62. Then, the fixing flanges 63 are pressurized toward the pressure roller 42 with a force of about 294 N by a pair of the right and left pressure springs 64 held by the fixing apparatus 40. The force brings the heater 60 into abutment against the pressure roller 42 with the fixing sleeve 41 interposed therebetween through the intermediation of the pressure stay 62 and the heater holder 61 from the fixing flanges 63.

The fixing flanges 63 are provided at both end portions in the longitudinal direction of the fixing sleeve (generatrix direction of the fixing sleeve 41) and regulate the movement of the fixing sleeve 41 in a radial direction and the generatrix direction of the fixing sleeve 41. That is, the fixing flanges 63 respectively include a regulation surface 63*a* (first surface) opposed to an inner surface of the fixing sleeve 41 and a regulation surface 63*c* (second surface) opposed to an end surface in a rotation axis direction (longitudinal direction) of the fixing sleeve 41.

Figure 6:
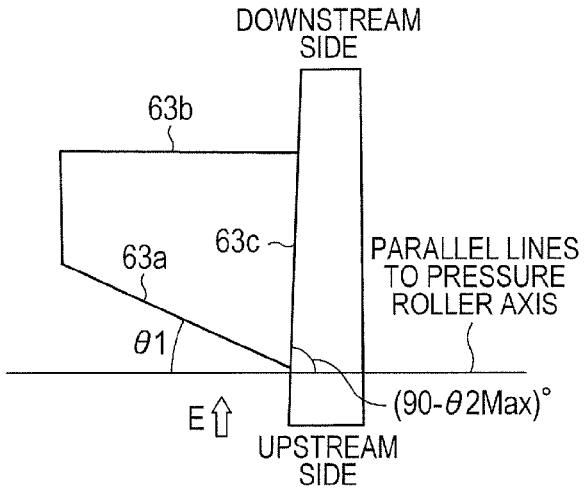
FIG. 6 is a schematic view of a fixing flange serving as a holding member of the fixing apparatus according to the first embodiment of the present invention.

FIG. 6 is a view of the fixing flange 63 on the right side of FIGS. 5A and 5B when viewed from an opposite side of the pressure roller 42 (arrow D direction of FIG. 5A). In the first embodiment, the regulation surface 63*a* opposed to an inner surface of the fixing sleeve 41 on an upstream side of the nip portion in the conveyance direction of a recording material has a first tapered shape. The regulation surface 63*a* has a shape (region) in which the distance between the inner surface of the fixing sleeve 41 and the regulation surface 63*a* in a radial direction of the sleeve increases toward a center portion (center of sheet conveyance region) of the fixing sleeve 41 in the generatrix direction of the fixing sleeve 41.

Further, the regulation surface 63*c* of the fixing flange 63 regulates the shift of the fixing sleeve 41 in the generatrix direction of the fixing sleeve 41. In the first embodiment, the force to reduce the shift described below is generated. In the case where the shift force of the fixing sleeve 41 is larger than the force to reduce the shift, the end surface of the fixing sleeve 41 is regulated by the regulation surface 63*c* of the fixing flange 63. In this case, the regulation surface 63*c* has a second tapered shape in which the distance between the end surface of the fixing sleeve 41 and the regulation surface 63*c* in the generatrix direction of the sleeve increases toward a downstream side in the conveyance direction of a recording material as illustrated in FIG. 6.

Sleeve Shift Force Control Mechanism

The shift force of the fixing sleeve 41 is controlled through use of the shape of the regulation surface 63*a* of the fixing flange 63 for regulating the inner surface of the fixing sleeve 41 (in particular, the component 63*s* illustrated in FIG. 5B) as described below with reference to FIGS. 1A and 1B. The regulation surface 63*a* regulates the inner surface of the fixing sleeve 41 at both end portions in the longitudinal direction of the fixing sleeve 41 on an upstream side of the nip portion, when the fixing sleeve 41 is driven to rotate through the drive of the pressure roller 42.

Figure 1A:
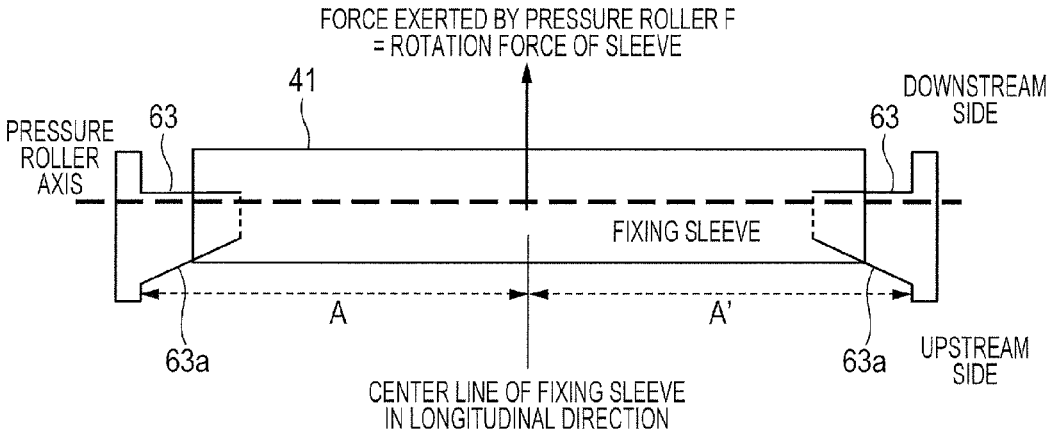
FIG. 1A is a view illustrating a state in which a shift does not occur in a fixing sleeve serving as a heating rotary member in a fixing apparatus serving as an image heating apparatus according to a first embodiment of the present invention.

FIG. 1A is a view of the fixing sleeve 41 and the fixing flanges 63 in a state in which shift does not occur, when viewed from an opposite side of the pressure roller 42 (arrow D direction of FIG. 5A). Distances A and A' of the fixing flanges 63 at both ends from a center line of the fixing sleeve 41 in a longitudinal direction illustrated in FIG. 1A are equal to each other, and the fixing sleeve 41 and the pressure roller 42 are parallel to each other. The driving force of the pressure roller 42 is transmitted as a rotation driving force of the fixing sleeve 41.

Figure 1B:
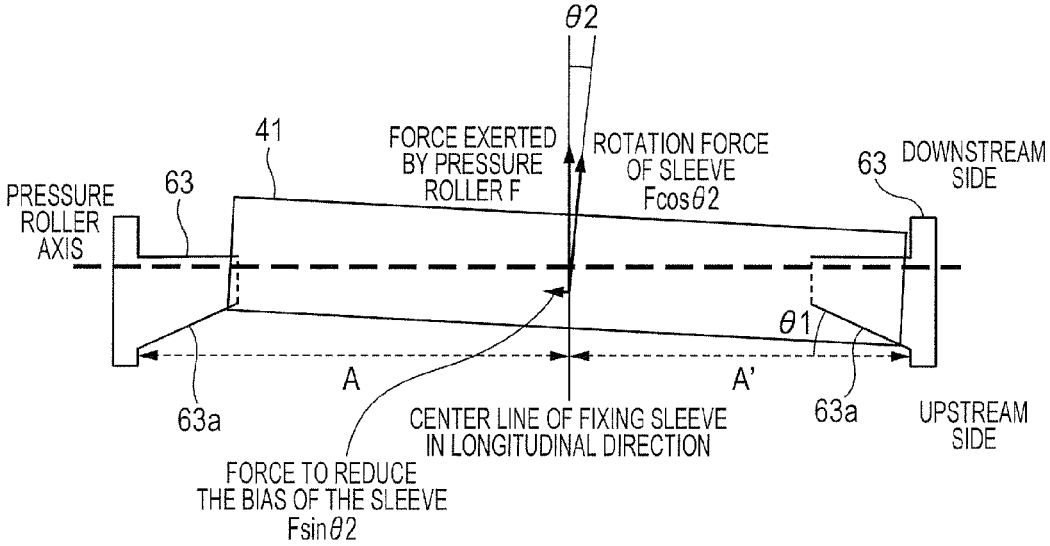
FIG. 1B is a view illustrating a state in which a shift occurs in the fixing sleeve.

On the other hand, FIG. 1B illustrates a state in which a shift occurs. In this case, the distances A and A' of the fixing flanges 63 at both ends from the center line of the fixing sleeve 41 in the longitudinal direction are not equal to each other, and the regulation surface 63*a* on the upstream side of the fixing flange 63 has a tapered shape. Therefore, the fixing sleeve 41 tilts in an illustrated direction, that is, a crossing angle is formed between the fixing sleeve 41 and the pressure roller 42.

The force exerted by the pressure roller 42 is generated in up and down directions in FIG. 1B, and the fixing sleeve 41 tilts in the illustrated direction, with the result that the following force is generated. That is, a force F exerted by the pressure roller 42 is decomposed into a rotation force component of the fixing sleeve 41 in a direction of θ2 for the force F and a component of a force to reduce the shift of the fixing sleeve 41 to a longitudinal direction center portion side, and hence the force to reduce the shift to the longitudinal direction center portion side is generated for the fixing sleeve 41.

The magnitude of the force to reduce the shift to the longitudinal direction center portion side is as follows. That is, a force F sin θ2 to reduce the shift of the fixing sleeve 41 is expressed by $(F\times(A-A')\sin\theta1)/L$, where θ1 represents a tapered angle of the regulation surface 63*a* of the fixing flange 63, L represents the length of the fixing sleeve 41, and θ2 represents a crossing angle of the fixing sleeve 41 and the pressure roller 42.

Therefore, the crossing angle θ2 increases as the shift becomes larger, with the result that the force to reduce the shift of the fixing sleeve 41 increases to reduce the shift force. Further, the force to reduce the shift of the fixing sleeve 41 increases as the tapered angle θ1 of the fixing flange 63 becomes larger, with the result that the shift force can be reduced. On the other hand, when the tapered angle θ1 of the fixing flange 63 is too large, the force to push up the end portion of the fixing sleeve 41 from the inner surface increases in the case where the fixing sleeve 41 is shifted, and there is a risk in that the end surface of the fixing sleeve 41 is ripped in a trumpet shape.

Therefore, it is necessary to set the tapered angle θ1 of the fixing flange 63 so that the effect of reducing shift of the fixing sleeve 41 is kept and the end surface of the fixing sleeve 41 is prevented from being ripped in a trumpet shape.

Further, in the case where the shift force of the fixing sleeve 41 is larger than the force F sin θ2 to reduce the shift of the fixing sleeve 41, the end surface of the fixing sleeve 41 is regulated by the regulation surface 63*c*. The regulation surface 63*c* of the fixing flange 63 has a tilt of (90−θ2Max)° with respect to an axial line of the pressure roller 42, where θ2Max represents a crossing angle between the fixing sleeve 41 and the pressure roller 42 when the fixing sleeve 41 is brought into contact with the regulation surface 63*c*. When the end surface of the fixing sleeve 41 collides with the regulation surface 63*c* having the tilt described above, buckling or the like in the fixing sleeve 41 is prevented, which may occur in the case where the shift force is concentrated in one place when the fixing sleeve 41 collides with the regulation surface 63*c* in FIG. 6.

Effect Confirmation Test

The effect of reducing the shift of the fixing sleeve 41 and the ripping of the fixing sleeve 41, which is a harmful effect, were confirmed by changing the tapered angle θ1 of the fixing flange 63. As a comparative example, a similar confirmation was also performed with respect to a tapered angle of 0°. Note that, a crossing angle between the pressure roller 42 and the fixing sleeve 41 formed due to an outer diameter difference and a component tolerance of the pressure roller 42 was set so that the shift is likely to occur in the fixing sleeve 41. Table 1 shows effect confirmation test results obtained by observing the state of the image heating apparatus after 75,000 recording materials of an A3 (297×420 mm) size were printed continuously.

TABLE 1

| Tapered angle θ1 | Shaving of end portion | Ripping of sleeve |
|---|---|---|
| 0° | There is a great amount of shavings of sleeve and flange. | No ripping occurs |
| 10° | There is a small amount of shavings of sleeve and flange. | No ripping occurs |
| 20° | There is a small amount of shavings of sleeve and flange. | No ripping occurs |
| 30° | There is a small amount of shavings of sleeve and flange. | Ripping of end portion in a trumpet shape occurs |

In the case where the tapered angle θ1 of the fixing flange 63 is 0°, there is no effect of reducing the shift of the fixing sleeve 41. In this case, the fixing sleeve 41 rotates while the end surface of the fixing sleeve 41 and the regulation surface 63*c* of the fixing flange 63 rub against each other strongly. Therefore, a great amount of shavings of the fixing flange 63 and the fixing sleeve 41 was generated.

On the other hand, in the case where the tapered angle θ1 of the fixing flange 63 is 10° or 20°, the force to reduce the shift of the fixing sleeve 41 acts to reduce the rubbing force. That is, although the fixing sleeve 41 rotates while rubbing against the regulation surface 63*c* of the fixing flange 63 after 75,000 recording materials are printed, the rubbing force between the fixing sleeve 41 and the regulation surface 63*c* of the fixing flange 63 is reduced by the force to reduce the shift. Thus, the amount of shavings of the fixing sleeve 41 and the fixing flange 63 was reduced compared to the case where the tapered angle θ1 was 0°. Further, there was no problem of ripping of the fixing sleeve 41 which might occur due to an increase in the tapered angle.

In the case where the tapered angle θ1 of the fixing flange 63 is 30°, the amount of shavings of the fixing sleeve 41 and the fixing flange 63 was reduced in the same way as in the case where the tapered angle θ1 was 10° or 20°. However, ripping of the end portion of the fixing sleeve 41 in a trumpet shape occurred.

From the results described above, in the first embodiment, the shaving of the fixing flange 63 and the fixing sleeve 41 can be suppressed by setting the tapered angle θ1 of the fixing flange 63 to 10° or 20°. It was also confirmed that ripping of the end portion of the fixing sleeve 41 which might occur as a harmful effect does not occur. Thus, the shift force of the fixing sleeve 41 can be reduced without strictly setting the size tolerance of the fixing member related to a crossing angle between the pressure roller 42 and the fixing sleeve 41.

Figure 10:
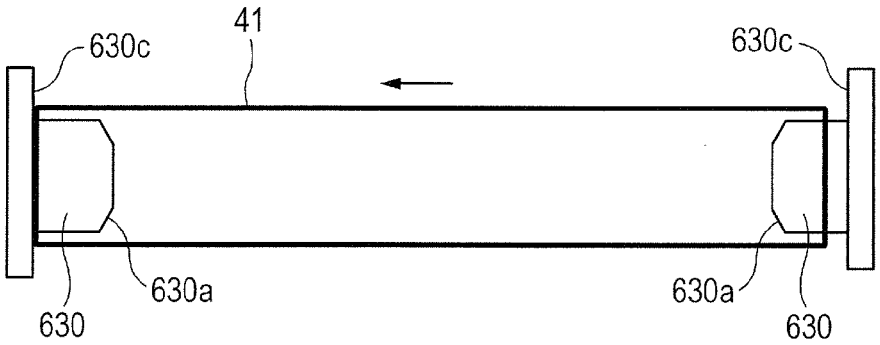
FIG. 10 illustrates an example of a fixing apparatus that is not included in the present invention.

A fixing flange that is not included in the first embodiment is now described. A fixing apparatus illustrated in FIG. 10 has a configuration in which, even in the case where the fixing sleeve 41 moves in the generatrix direction of the fixing sleeve 41, and one end surface of the fixing sleeve 41 is brought into contact with a regulation surface 630*c* of one fixing flange 630, the other end surface of the fixing sleeve 41 is not brought into contact with a tapered portion 630*a* of the other fixing flange 630. This is because the force to reduce the shift of the fixing sleeve 41 is not generated unless the end surface of the fixing sleeve 41 is brought into contact with the tapered portion 630*a* of the fixing flange 630, and the functional effect of the first embodiment is not obtained.

Second Embodiment

A second embodiment of the present invention is hereinafter described. In the first embodiment, in the case where the shift force of the fixing sleeve 41 is larger than the force to reduce the shift, the shift force is finally regulated by the regulation surface 63*c* of the fixing flange 63. In the second embodiment, the shift is regulated by setting the diameter of an inner receiving portion of the fixing sleeve 41 to be larger than the inner diameter of the fixing sleeve 41.

In the fixing flange 63 of the second embodiment, the regulation surface 63*a* has a first tapered shape, and the regulation surface 63*c* has a second tapered shape in the same way as in the first embodiment.

Figure 7:
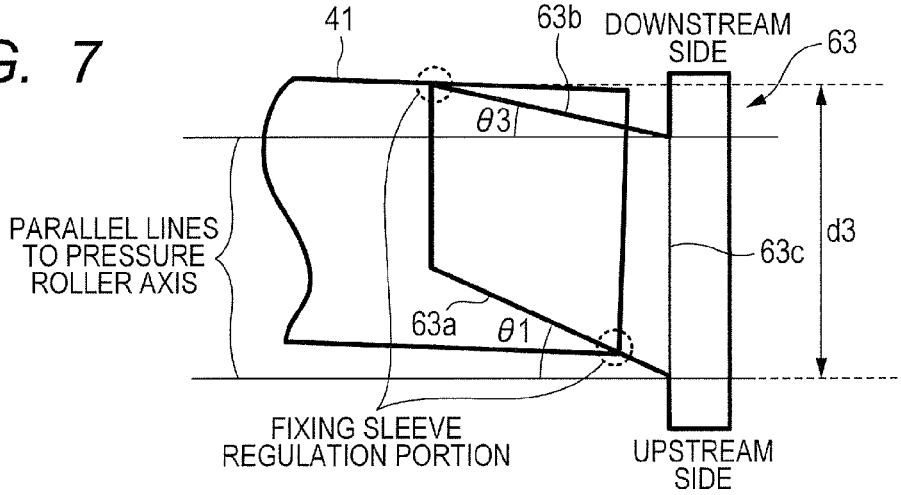
FIG. 7 is a view illustrating shift regulation for a heating rotary member by a holding member in a fixing apparatus according to a second embodiment of the present invention.

FIG. 7 illustrates the feature of the fixing flange 63 of the second embodiment. In this embodiment, the regulation surface 63*b* on a downstream side of the nip portion in the conveyance direction of a recording material has a third tapered shape (region) in which the distance between the inner surface of the fixing sleeve 41 and the regulation surface 63*b* in a radial direction of the sleeve decreases toward the center portion of the fixing sleeve 41 in the generatrix direction of the fixing sleeve 41. That is, the third tapered shape is a taper in a direction opposite to that of the first tapered shape, and the tapered angle of the regulation surface 63*b* is θ3.

The second embodiment has a feature in that, as illustrated in FIG. 7, a distance d3 between a contact point (most upstream side) of the regulation surface 63*a* and the regulation surface 63*c*, and a tip end (most downstream side) of the regulation surface 63*b* in the conveyance direction of a recording material (sheet feeding direction) is larger than the inner diameter of the fixing sleeve 41. Thus, even when the fixing sleeve 41 is shifted, the shift is regulated by the regulation surface 63*a* and the regulation surface 63*b* of the fixing flange 63 before the fixing sleeve 41 is brought into contact with the regulation surface 63*c* of the fixing flange 63.

When the above-mentioned relationship is satisfied, there is no possibility that the regulation surface 63*c* of the fixing flange 63 and the end surface of the fixing sleeve 41 may rub against each other. Further, the inner surface of the fixing sleeve 41 is supported at two positions: the regulation surface 63*a* on the upstream side and the tip end of the regulation surface 63*b* on the downstream side. According to this configuration, the force which the fixing sleeve 41 moves to receive from the fixing flange 63 can be dispersed into the above-mentioned two positions, and hence ripping of the fixing sleeve 41 can be prevented.

Figure 8:
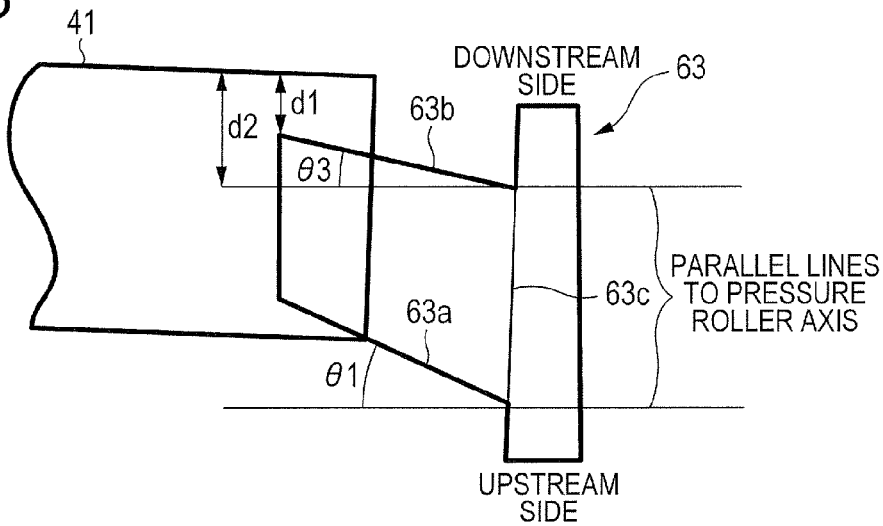
FIG. 8 is a view illustrating a positional relationship between the heating rotary member and the holding member in the second embodiment of the present invention.

Further, the following effect is also obtained owing to the tapered shape of the regulation surface 63*b* of the fixing flange 63 on the downstream side of the fixing nip portion. That is, in the case where the fixing sleeve 41 is shifted on a side opposite to the fixing flange 63 as illustrated in FIG. 8, the regulation surface 63*b* of the fixing flange 63 at the downstream side is positioned at a distance d1 from the inner surface of the fixing sleeve 41. On the other hand, in the case where the fixing flange 63 on the downstream side does not have a tapered shape, the distance between the inner surface of the fixing sleeve 41 and the fixing flange 63 on the downstream side increases as indicated by d2.

In the case where a recording material jammed in the fixing nip is pulled out from the upstream side to clear the jam, the fixing sleeve 41 rotates while the inner surface thereof is regulated by the regulation surface 63*b* of the fixing flange 63 on the downstream side. When the distance between the inner surface of the fixing sleeve 41 and the fixing flange 63 on the downstream side is large, a deformation amount of the end portion of the fixing sleeve 41 becomes large, and the fixing sleeve 41 is damaged. The distance between the inner surface of the fixing sleeve 41 and the fixing flange 63 on the downstream side can be reduced from d2 to d1 by forming the fixing flange 63 on the downstream side in a tapered shape, and hence the deformation of the fixing sleeve 41 that may be caused by clearing the jam is suppressed to alleviate damage.

Third Embodiment

A third embodiment of the present invention is hereinafter described. The third embodiment is preferred in the case of using a fixing sleeve having different ripping strengths at both ends due to the difference in a processing method or the like. In the foregoing embodiments, the fixing flanges 63 at both end portions have the first tapered angle θ1. In the third embodiment, a fixing flange at one end portion is provided with the first tapered angle θ1. That is, in the third embodiment, both ends of the fixing sleeve 41 have different ripping strengths, and only the fixing flange serving as a holding member at one end portion having ripping strength higher than that of the other end portion is provided with the first tapered shape (angle θ1).

Figure 9:
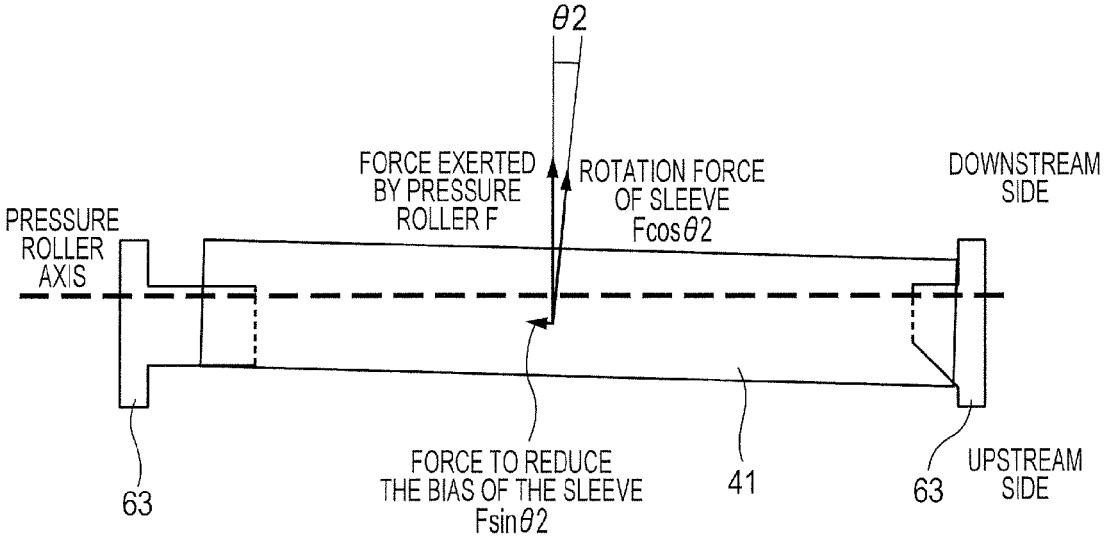
FIG. 9 is a view illustrating shift regulation for a heating rotary member by a holding member in a fixing apparatus according to a third embodiment of the present invention.

FIG. 9 is a view of the fixing sleeve 41 and the fixing flanges 63 when viewed from a side opposite to the pressure roller 42 (arrow D direction of FIG. 5A). In the third embodiment, the fixing sleeve 41 is disposed in such a manner that the side of the fixing sleeve 41 having higher ripping strength is positioned on the right side of FIG. 9. Further, a tapered angle is formed on a surface supporting the end portion of the fixing sleeve 41 only in the fixing flange 63 on the right side.

According to the above-mentioned configuration, the first tapered angle θ1 of the fixing flange 63 enables a force for causing ripping of the fixing sleeve 41 to be applied to only the side of the fixing sleeve 41 having higher strength. Therefore, the end portion of the fixing sleeve 41 can be prevented from being ripped. The mechanism of the force to reduce the shift of the fixing sleeve 41 is described in the first embodiment, and hence the description thereof is omitted here.

As means for enhancing the ripping strength on one side of the fixing sleeve 41, there are provided a method involving reinforcing the end portion with a reinforcing tape, a method involving setting the thickness of the fixing sleeve 41 to be larger, and the like. Further, in the third embodiment, although the fixing flange 63 described in the first embodiment is used, the fixing flange 63 described in the second embodiment may be used.

Modified Example

The first to third embodiments have been described above. However, the present invention is not limited thereto, and the technical matters disclosed in the respective embodiments may be appropriately combined and variously modified as exemplified below within the scope of the present invention.

Modified Example 1

In the above-mentioned embodiments, the regulation surface 63*a* of the fixing flange 63 serving as a holding member at the upstream side of the nip portion in the conveyance direction of a recording material has the first tapered shape, and the regulation surface 63*c* has the second tapered shape. However, the regulation surface 63*c* may be parallel to the end surface of the sleeve.

Modified Example 2

Although the first tapered shape of the regulation surface 63*a* illustrated in FIGS. 6 to 9 is a linear taper, the present invention is not limited thereto. That is, the regulation surface 63*a* may be a parabolic taper or an exponential taper, as long as the distance between the regulation surface 63*a* and the inner surface of the fixing sleeve 41 increases from the regulation surface 63*c* to the center portion of the fixing sleeve 41 in the generatrix direction of the fixing sleeve 41. Similarly, the regulation surface 63*b* may be a parabolic taper or a exponential taper in the same way as in the regulation surface 63*a*.

Modified Example 3

The scope of the present invention is not limited to the material, shape, and relative arrangement of constituent components described in the foregoing embodiments unless otherwise specified. For example, in the foregoing embodiments, although SUS is used as a material for the base layer 41*a* of the fixing sleeve 41, a metal other than SUS such as Ni and Al or a resin such as polyimide may be used.

Modified Example 4

Further, the fixing sleeve 41 is not limited to those heated by a heater as described in the foregoing embodiments. The fixing sleeve 41 may be those which include an electric conduction part and perform self-heating or those which generate heat through electromagnetic induction.

Modified Example 5

Further, in the foregoing embodiments, although the pressure roller 42 serving as a driving roller is used as a pressure member, a fixed pressure pad serving as a pressure member can also be used in the case where the fixing sleeve 41 is mounted through the intermediation of another driving roller and is capable of rotating.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-270301, filed Dec. 11, 2012, which is hereby incorporated by reference herein in its entirety.

What is claimed is:

1. A fixing apparatus for fixing a toner image onto a recording material by heating the recording material bearing the toner image while conveying the recording material at a nip portion, comprising:

a sleeve;

a nip portion forming member that contacts an inner surface of the sleeve;

a pressure member that forms the nip portion together with the nip portion forming member through the sleeve; and a regulation member that regulates a movement of the sleeve in a generatrix direction of the sleeve, the regulation member including a first surface opposed to an inner surface of an end portion of the sleeve in the generatrix direction, and a second surface, positioned farther away from a center portion of the sleeve in the generatrix direction than the first surface and opposed to an end surface of the sleeve in the generatrix direction, wherein the first surface includes an upstream side region, on an upstream side of the nip portion in a conveyance direction of the recording material, in which the distance between the inner surface of the sleeve and the first surface in a radial direction of the sleeve increases toward the center portion of the sleeve in the generatrix direction of the sleeve, wherein the upstream side region on the first surface is arranged at a position closer to the center portion of the sleeve in the generatrix direction than a contact portion on the second surface which the end surface of the sleeve contacts at first when the sleeve moves toward the regulation member, and wherein the end surface of the sleeve contacts the upstream side region when the sleeve moves in the generatrix direction.

2. A fixing apparatus according to claim 1, wherein the first surface includes a downstream side region, on a downstream side of the nip portion in the conveyance direction, in which the distance between the inner surface of the sleeve and the first surface in the radial direction decreases toward the center portion of the sleeve in the generatrix direction, wherein the downstream side region on the first surface is arranged at a position closer to the center portion of the sleeve in the generatrix direction than the contact portion on the second surface, and wherein the end surface of the sleeve contacts the downstream side region when the sleeve moves in the generatrix direction.

3. A fixing apparatus according to claim 1, wherein the first surface includes a downstream side region, on a downstream side of the nip portion in the conveyance direction, in which the distance between the inner surface of the sleeve and the first surface in the radial direction is constant toward the center portion of the sleeve in the generatrix direction, and wherein the downstream side region on the first surface is arranged at a position closer to the center portion of the sleeve in the generatrix direction than the contact portion on the second surface.

4. A fixing apparatus according to claim 1, wherein the second surface comprises a region in which the distance between the end surface of the sleeve and the second surface in the generatrix direction increases toward a downstream side in the conveyance direction.

5. A fixing apparatus according to claim 1, wherein the regulation member includes regulation members provided at both end portions of the sleeve in the generatrix direction.

6. A fixing apparatus according to claim 1, wherein the nip portion forming member comprises a heater.

* * * * *